US008491180B2

(12) United States Patent
Hirschberg et al.

(10) Patent No.: US 8,491,180 B2
(45) Date of Patent: Jul. 23, 2013

(54) STATIC MIXING ELEMENT

(75) Inventors: Sebastian Hirschberg, Winterthur (CH); Joachim Schoeck, Winterthur (CH); Markus Fleischli, Winterthur (CH); Felix Moser, Neftenbach (CH)

(73) Assignee: Sulzer Chemtech AG, Winterthur (CH)

( * ) Notice: Subject to any disclaimer, the term of this patent is extended or adjusted under 35 U.S.C. 154(b) by 905 days.

(21) Appl. No.: 12/451,782

(22) PCT Filed: Jun. 10, 2008

(86) PCT No.: PCT/EP2008/057226
§ 371 (c)(1),
(2), (4) Date: Nov. 30, 2009

(87) PCT Pub. No.: WO2009/000642
PCT Pub. Date: Dec. 31, 2008

(65) Prior Publication Data

US 2010/0202248 A1 Aug. 12, 2010

(30) Foreign Application Priority Data

Jun. 22, 2007 (EP) ..... 07110892

(51) Int. Cl.
*B01F 5/06* (2006.01)

(52) U.S. Cl.
USPC ..... 366/337

(58) Field of Classification Search
USPC ..... 366/336, 337
See application file for complete search history.

(56) References Cited

U.S. PATENT DOCUMENTS

| | | | | | |
|---|---|---|---|---|---|
| 3,406,947 | A | * | 10/1968 | Harder | 366/337 |
| 4,062,524 | A | | 12/1977 | Brauner | |
| 4,093,188 | A | * | 6/1978 | Horner | 366/336 |
| 4,220,416 | A | * | 9/1980 | Brauner et al. | 366/337 |
| 4,692,030 | A | * | 9/1987 | Tauscher et al. | 366/337 |
| 4,865,460 | A | * | 9/1989 | Friedrich | 366/337 |
| RE34,255 | E | * | 5/1993 | Friedrich | 366/337 |
| 5,378,063 | A | * | 1/1995 | Tsukada | 366/337 |
| 5,564,827 | A | | 10/1996 | Signer | |
| 5,620,252 | A | * | 4/1997 | Maurer | 366/337 |
| 5,688,047 | A | * | 11/1997 | Signer | 366/337 |
| 5,813,762 | A | * | 9/1998 | Fleischli et al. | 366/337 |
| 5,865,537 | A | * | 2/1999 | Streiff et al. | 366/174.1 |
| 6,109,781 | A | * | 8/2000 | Ogasawara et al. | 366/336 |

(Continued)

FOREIGN PATENT DOCUMENTS

| | | |
|---|---|---|
| CH | 642 564 A5 | 4/1984 |
| CH | 642564 | 4/1984 |

(Continued)

*Primary Examiner* — Tony G Soohoo
(74) *Attorney, Agent, or Firm* — Francis C. Hand; Carella, Byrne et al.

(57) ABSTRACT

A static mixing element for installation in a hollow body (10) includes a plurality of bar elements, with a first arrangement (21) including at least one first bar element (3) and being arranged cross-wise with respect to a second arrangement (31) which includes at least one second bar element (4). The first arrangement (21) and the second arrangement (31) include an angle different from 0° to the main direction of flow. The first arrangement includes an angle larger than 0° with the second arrangement. On projection of the first arrangement (21) and of the second arrangement (31) onto a projection plane which is disposed normal to the main direction of flow, intermediate spaces are disposed at least partly between mutually adjacent bar elements.

18 Claims, 6 Drawing Sheets

U.S. PATENT DOCUMENTS

Figure 1:
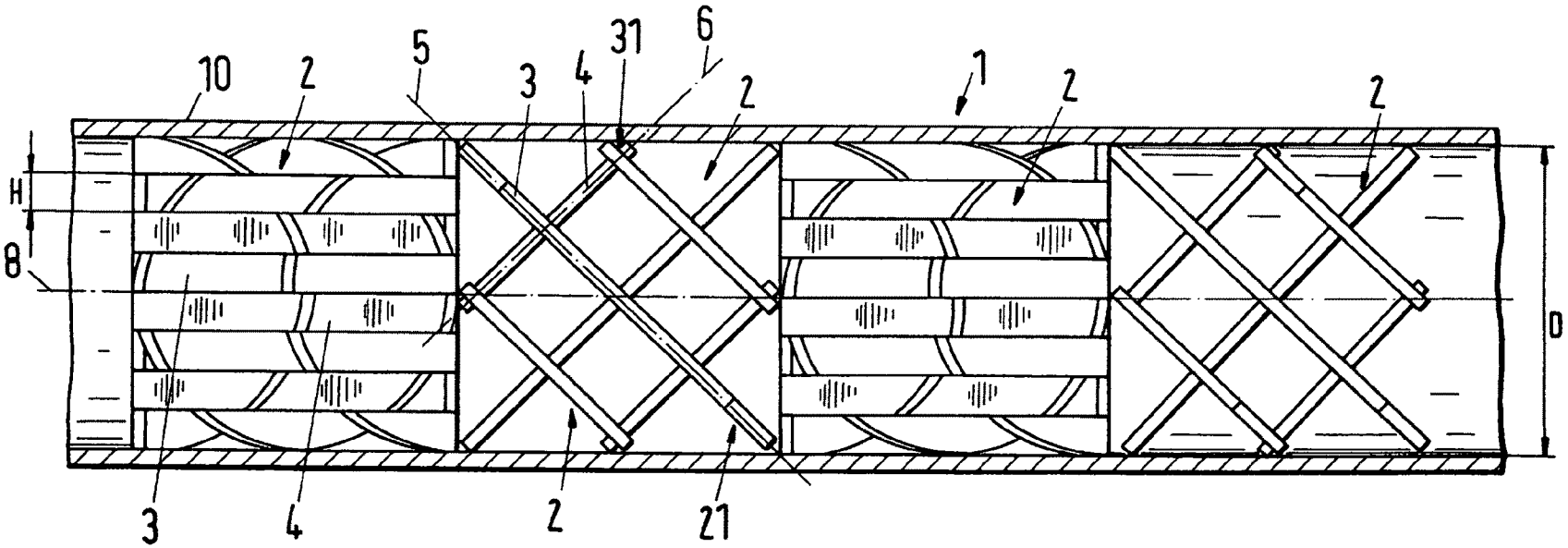

| | | | | |
|---|---|---|---|---|
| 6,203,188 | B1 * | 3/2001 | Maurer et al. | 366/338 |
| 6,394,644 | B1 * | 5/2002 | Streiff | 366/337 |
| 6,595,679 | B2 * | 7/2003 | Schuchardt | 366/147 |
| 6,595,682 | B2 * | 7/2003 | Mathys et al. | 366/337 |
| 6,637,928 | B2 * | 10/2003 | Schuchardt | 366/337 |
| 8,375,708 | B2 * | 2/2013 | Forster et al. | 60/324 |
| 2001/0012235 | A1 | 8/2001 | Schuchardt | |
| 2004/0125691 | A1 | 7/2004 | Streiff | |
| 2010/0202248 | A1 * | 8/2010 | Hirschberg et al. | 366/337 |

FOREIGN PATENT DOCUMENTS

| | | | |
|---|---|---|---|
| DE | 23 28 795 | | 1/1975 |
| DE | 4428813 | | 2/1996 |
| EP | 0 070 915 | A | 2/1983 |
| EP | 0 154 013 | | 9/1985 |
| EP | 0 856 353 | A | 8/1998 |
| EP | 0856353 | | 8/1998 |
| EP | 1 123 730 | A | 8/2001 |
| JP | 56-62531 | | 5/1981 |
| JP | 58-27633 | | 2/1983 |
| JP | 8-309170 | | 11/1996 |
| JP | 9-122465 | | 5/1997 |
| JP | 2005-532900 | | 11/2005 |
| RU | 2091146 | | 9/1997 |
| WO | WO 02/09858 | A2 | 2/2002 |
| WO | WO 03/097537 | | 11/2003 |

* cited by examiner

STATIC MIXING ELEMENT

The invention relates to a static mixing element in accordance with the preamble of claim 1. The invention also relates to a static mixer including such a mixing element.

A static mixing apparatus is known from the prior art in accordance with CH 642 564 which consists of a tubular housing and includes at least one mixing element arranged therein. The mixing element consists of crossing bars which have an angle with respect to the tube axis. The bars of the mixing elements are arranged in at least two groups. The bars within each group are aligned substantially parallel. The bars of the one group intersect with the bars of the other group.

DE 44 28 813 shows a static mixing apparatus which, in contrast to CH 642 564, has crossing bars which overlap in the region of the points of intersection. This local widening of the bars which are made as sheet steel bars in DE 44 28 813 serves for the reinforcement and/or for the forming of a shape matched connection of adjacent bars. A groove is cut into the widened portion which receives an adjacent bar made of steel sheet material.

EP 0 856 353 A1 shows a module which is part of a static mixing device which is provided for a plastically flowable mixing product having a critical residence time. The device includes a tubular housing in which bars are arranged. The bars are inclined with respect to the longitudinal axis of the housing; they cross substantially on a straight line perpendicular to the longitudinal axis. The module includes a sleeve which is insertable into the housing. The inner wall of the static mixing device guiding the mixing product is formed by inner sides of the sleeve. The bars are made in the manner of mandrels each having an apex facing toward the direction of movement of the mixing product and a base fastened to the inner side of the sleeve. Each apex forms an intermediate space with respect to the inner wall of the device.

The development of the mixer in accordance with CH 642 564 in 1979 represented an unexpected improvement in static mixing technology for media flowing in a laminar manner. This mixer has proved itself since then and it is used successfully in a very broad field of applications with largely highly viscous media. Attempts were made again and again to improve this mixer in the almost 30 following years. However, only marginal improvements were able to be recorded despite a substantial effort and/or expense. A modified mixer having a changed, concave bar cross-section was thus protected in U.S. Pat. No. 6,467,949 B1. Independent measurements (M. Heniche, P. A. Tanguy, M. F. Reeder, J. B. Fasano, AIChE Journal Vol 51, No. 1, January 2005) showed only slight differences with respect to pressure loss and mixing efficiency for this modified static mixer with respect to the prior art. In another recently published paper (S. Liu, PhD Thesis, McMaster University, 2005), a plurality of modifications of the prior art in accordance with CH 642 564 for the improvement of mixing efficiency and pressure drop were examined using different techniques. The mixing elements in accordance with U.S. Pat. No. 6,467,949 B1 were also measured in this paper. Liu records a 15% lower pressure loss with the same mixing effect or one which is a little worse. By a further change in the bar cross-section, Liu additionally achieves a somewhat better mixing effect with a pressure loss reduced by 7.5% with the respect to the mixer in accordance with CH 642 564. These examples of studies for the improvement and examination of the mixing behaviour of static mixers which have a similar structure to the mixer in accordance with CH 642 564 show that no substantial improvements in mixing efficiency and pressure drop of laminar mixers were able to be achieved to date.

Surprisingly, static mixer elements can be found to which the above statement does not apply, where even a contrary statement is correct. The clear reduction in pressure loss observed using a mixing element in accordance with the invention with a similar or improved mixing efficiency recorded by the mixing elements in accordance with the invention is a technical breakthrough.

It is the object of the invention to provide an improvement for the named static mixer with which a lower pressure loss can be recorded with a comparable or improved mixing efficiency.

This object is satisfied by the static mixing element defined in the following.

A static mixing element in accordance with the invention has a width Db and is suitable for installation in a hollow body with a width substantially equal to Db. The static mixing element includes a plurality of bar elements, with a first arrangement including at least one first bar element and being arranged cross-wise with respect to a second arrangement which includes at least one second bar element. The first arrangement and the second arrangement include an angle different from 0° to the main direction of flow. The first arrangement and the second arrangement include an angle larger than 0°. On projection of the first arrangement and of the second arrangement onto a projection plane which is disposed normal to the main direction of flow, intermediate spaces are disposed at least partly between mutually adjacent bar elements. The relative sum z of the widths of the bar elements measured in the direction of the width Db of the mixing element is smaller than 95% of the width Db of the mixing element.

The further features relate to advantageous embodiments of the static mixing element as well as of a static mixer which includes the mixing element in accordance with the invention.

The main direction of flow is preferably disposed in the direction of the longitudinal axis of a hollow body in which the mixing element is received. A crossing point is formed by the first arrangement and the second arrangement in whose proximity a spacer element can be arranged. The spacer element can be made as a local thickened portion or widened portion of at least one bar element. The number of the bar elements can amount to 4 to 10 in the projection plane. At least 2 bar elements are advantageously provided per arrangement. The first and the third bar elements are part of a first arrangement of bar elements disposed in a first plane. The second and the fourth bar elements are part of a second arrangement of bar elements disposed in a second plane. At least some of the bar elements of the first arrangement can be arranged in a third plane which is arranged offset to the first plane. Alternatively or in addition thereto, some of the bar elements of the second arrangement can be arranged in a fourth plane, with the fourth plane being arranged offset to the second plane. The bar elements have a width (H). The sum ($\Sigma Hi$) of the widths (H) of the bar elements in the projection plane in relation to the diameter (D) of the hollow body is fixed by the parameter z defined in the following. The parameter z is in particular less than 95%, preferably less than 85%, in particular less than 75%, particularly preferably less than 65%. The static mixing apparatus includes a static mixing element as well as a hollow body or a sleeve to receive the static mixing element. The static mixing element can be fastened to the hollow body or to the sleeve, with the static mixing element and the hollow body or the sleeve being able to consist of a single component.

The static mixing element can be fastened to the inner wall of the hollow body or of the sleeve in the region of the line of intersection of the first plane with the second plane and/or in the region of at least some of the ends of the bar elements.

The preferred use of a static mixing element in accordance with one of the preceding embodiments takes place for media with a laminar flow, in particular polymer melts or other highly viscous fluids.

Figure 2:
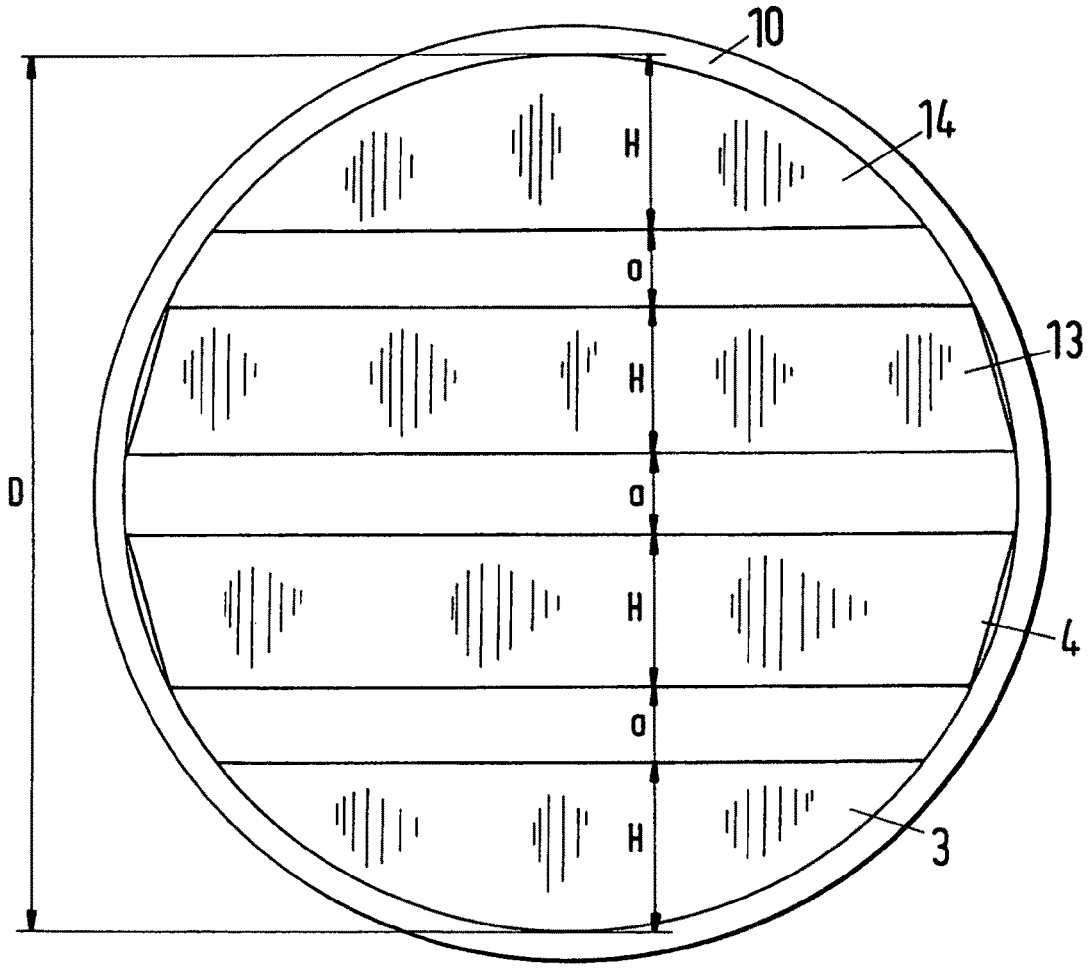
Figure 3:
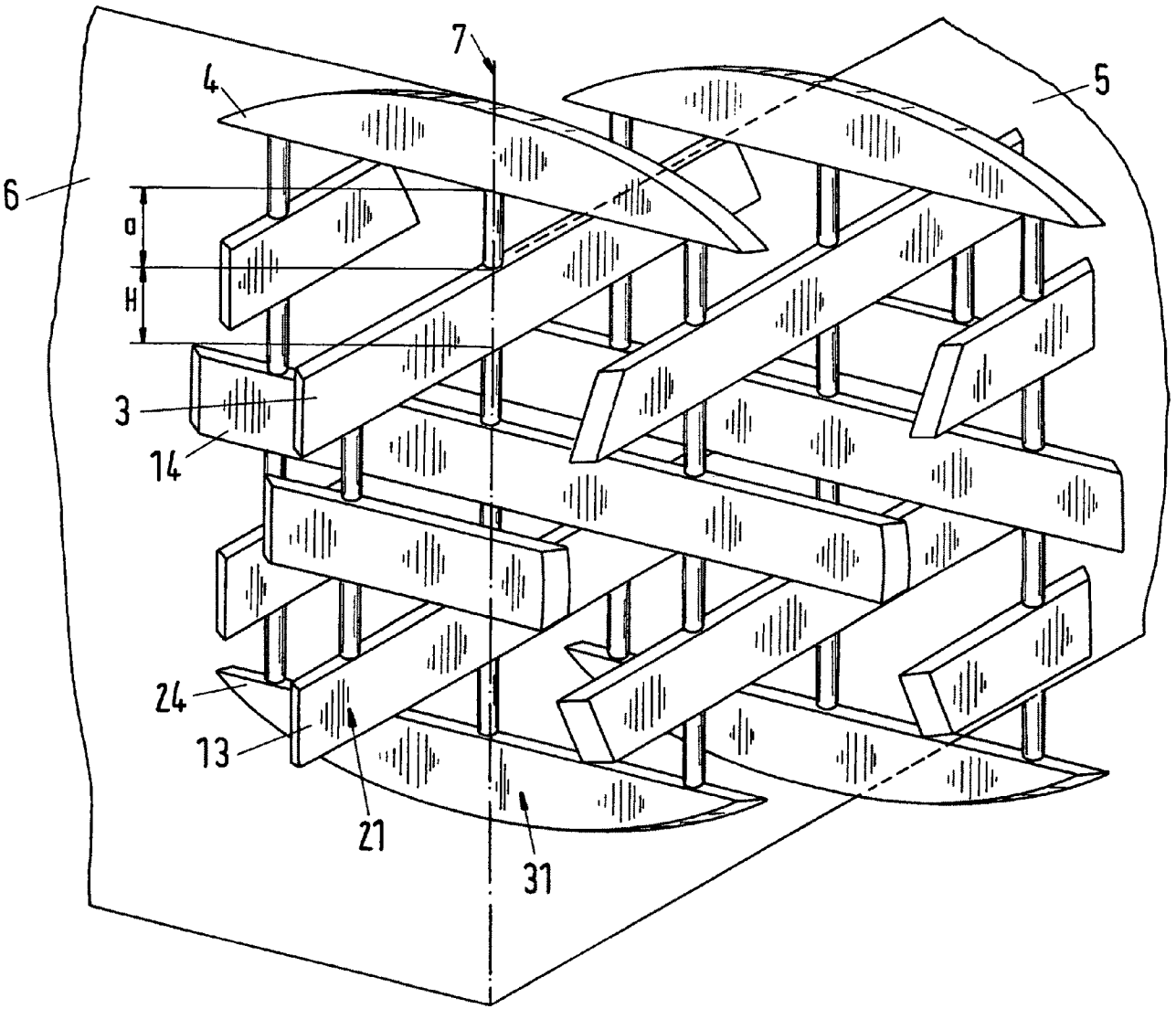
Figure 4:
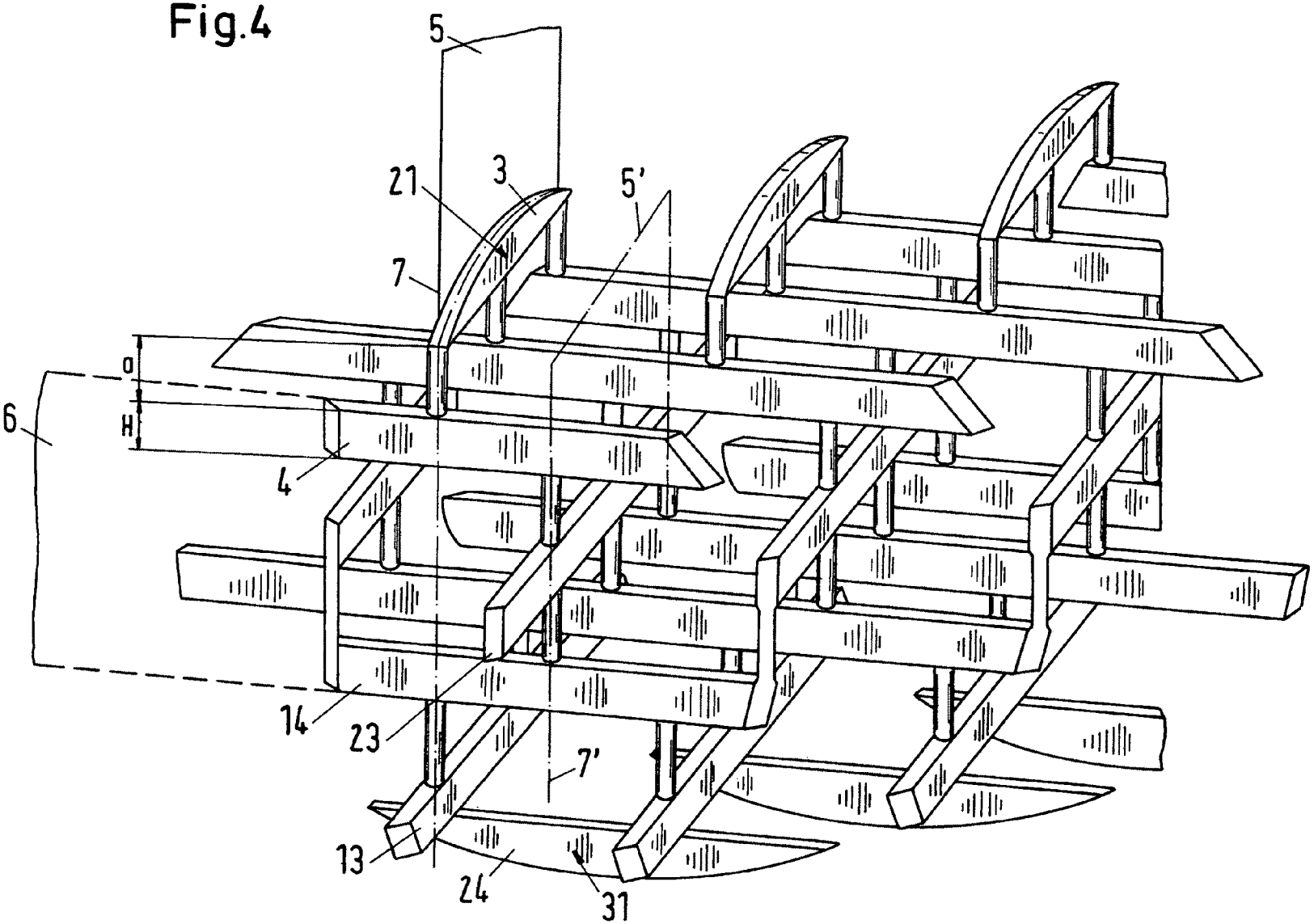
Figure 5:
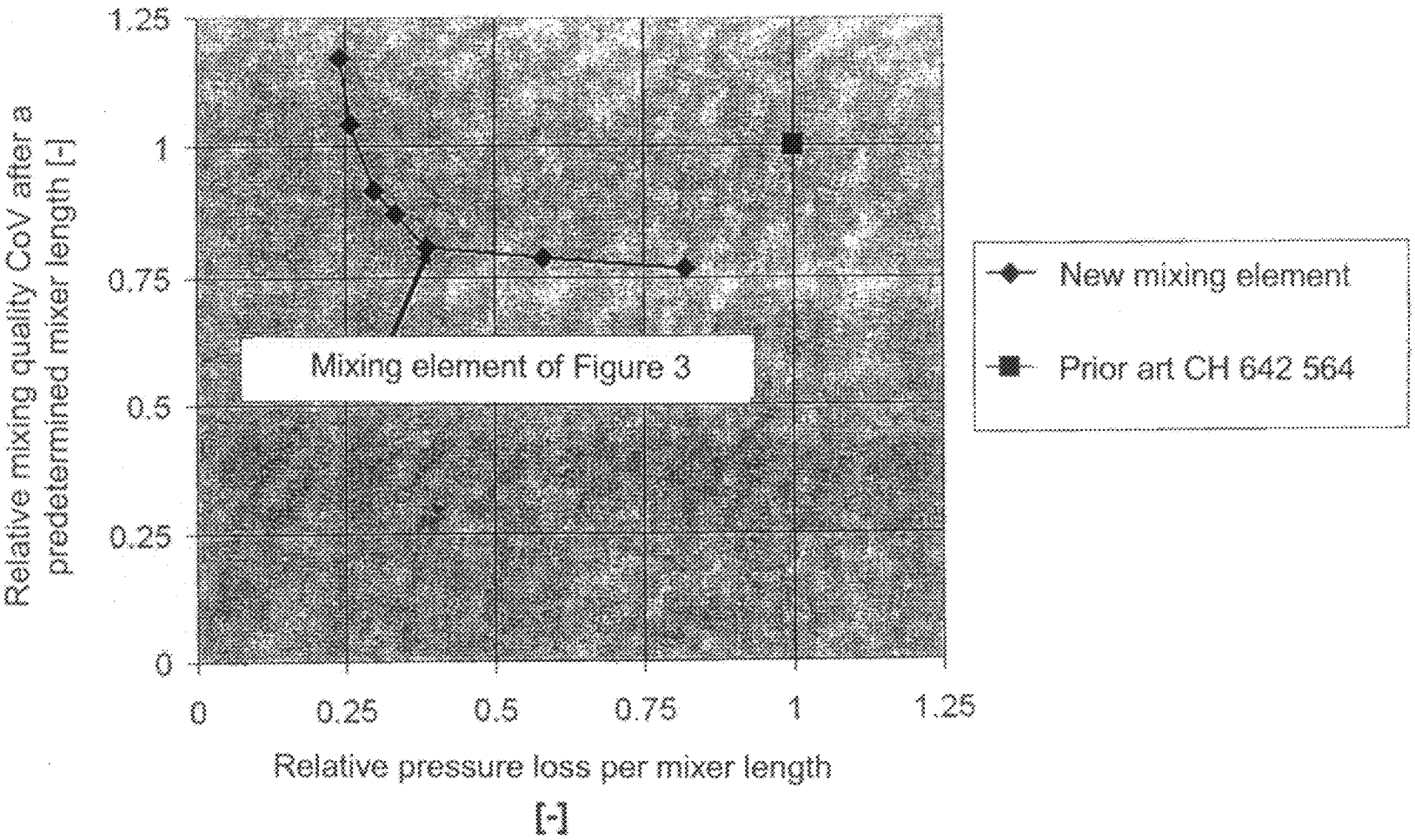
Figure 6:
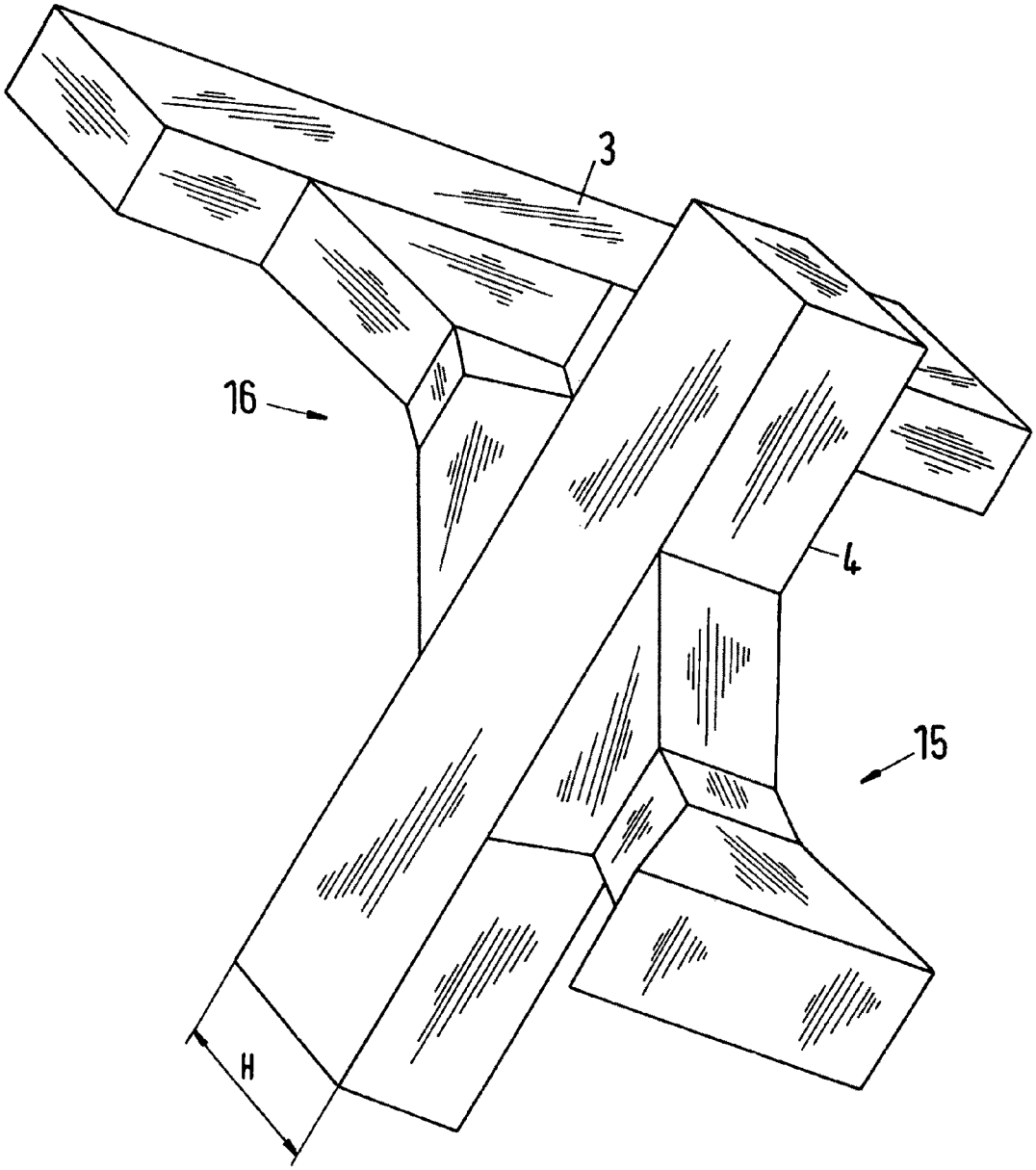

The invention will be explained in the following with reference to the drawings. There are shown:

FIG. 1 a static mixing apparatus in accordance with the prior art;

FIG. 2 a view of a static mixing element in accordance with the invention in accordance with a first embodiment;

FIG. 3 a second embodiment of a static mixing element in accordance with the invention;

FIG. 4 a third embodiment of a static mixing element in accordance with the invention, FIG. 5 a graphical illustration of a comparison of the results of pressure drop and mixing efficiency of a mixing element in accordance with the invention in different design variants with respect to the prior art of CH 642 564;

FIG. 6 a detail of a crossing region having spacer elements with local thickened portions and widened portions.

FIG. 1 shows four mixing elements which are arranged sequentially in a hollow body 10. Sequential mixing elements 2 are pivoted about an angle of 90° with respect to one another around the hollow body axis 8 acting as an axis of rotation. The main direction of flow of the fluid flowing through the hollow body 10 is disposed in the direction of the hollow body axis 8. Each mixing element consists of arrangements of bar elements (3, 4) which are arranged in two crossing planes (5, 6). An arrangement of bar elements in this connection designates a number of bar elements which are substantially disposed in one plane. The first plane 5 includes a first arrangement 21 of bar elements 3; a second plane 6 includes a second arrangement 31 of bar elements 4. The first and the second planes (5, 6) are arranged at an angle to one another so that the first arrangement 21 of bar elements 3 intersects with the second arrangement 31 of bar elements 4. Adjacent bar elements are disposed next to one another such that the sum of the widths (H) of the bar elements is equal to the tube diameter (D). In this case, the bar elements are therefore directly adjacent one another. In accordance with this embodiment, each flowing fluid molecule impacts on a bar element under the idealised assumption that the fluid molecule was flowing along the main direction of flow. Each bar element thus represents an obstacle for the flowing fluid molecule so that a deflection of the fluid molecule takes place before it impacts onto the bar element. The assumption thus no longer applies in the interior of the static mixing element that a fluid molecule flows in the direction of the main flow direction. A mixing of the fluid flow takes place by the deflection of the fluid molecule from the main direction of flow. It follows from this that the mixing effect should improve with an increasing deflection from the main direction of flow. An increasing deflection of the fluid molecules from the main direction of flow, however, generally signifies an increased pressure loss.

Since it is generally known that the pressure loss reduces when the cross-section through which there is a flow is as free as possible of obstacles, it appears obvious to avoid obstacles in the flow to reduce the pressure loss. However, a poorer mixing would then have to be expected after the same mixing distance because, according to the previous opinion, fluid elements flow through the gaps thus created without being substantially deflected, that is substantially following the main direction of flow without mixing with other fluid molecules. Surprisingly, arrangements of bar elements in accordance with FIG. 2 can be found to which this statement does not apply. A static mixing element 2 in accordance with the invention for installation into a hollow body 10 includes a plurality of bar elements. A first bar element 3 and a third bar element 13 are arranged cross-wise relative to a second bar element 4 and a fourth bar element 14. The first bar element 3 and the third bar element 13 form a first arrangement 21 of bar elements. The second bar element 4 and the fourth bar element 14 form a second arrangement 31 of bar elements.

A bar element can be designed, for example, as a tube or as a plate-like, disk-like or bar-like element. The cross-section of the bar element can be free of edges, e.g. have a circular or elliptical cross-section. The cross-section can include edges, that is, for example, can have a rectangular or diamond-shaped cross-section. The connection lines between the edges can be straight or curved, can in particular be convex or concave, which is realised, for example, in EP 1 305 108 B1. A bar element can project at least section-wise out of the associated arrangement, for example have a wavy structure. In this case, the previously described plane of the arrangement is to be understood as a middle plane.

Furthermore, the bar elements can also have an irregular structure, e.g. a wavy surface, in the direction of an arrangement, i.e. in the corresponding plane or parallel to the middle plane. The width H of the bar elements is in this case defined as the width of the bar elements averaged over the bar length. The individual bar elements also do not have to extend parallel to one another within an arrangement, but they can rather have an angle with respect to the other bar elements of the same arrangement.

The surprising effect of the invention occurs in each of the bar element cross-sections set forth and in each of the bar element shapes; it is therefore largely independent of the cross-section and of the shape of the bar element. If the two arrangements 21 and 31 are projected onto a plane which is disposed normal to the main direction of flow, that is normal to the longitudinal axis 8 of the enveloping hollow body 10, the bar elements of the arrangements 21 and 31 in accordance with FIG. 1 are disposed flush with respect to one another, that is there are no intermediate spaces between the bar elements projected in this manner. If, in contrast, the same projection is made in one of the embodiments in accordance with FIGS. 2 to 4, then intermediate spaces of this type are present between the bar elements.

FIG. 2 shows a radial section through a hollow body 10 in which precisely these projections of the bar elements 3, 13 or of the bar elements 4, 14 are shown. The bar elements in this representation have the width (H) and have a spacing (a) from one another, with the widths (H) and the spacings (a) of adjacent bar elements in accordance with this particularly preferred embodiment being equal. The surprising effect of the invention also occurs when the spacings (a) and/or the widths (H) differ from one another.

FIG. 3 shows a second embodiment of a mixing element in accordance with the invention. A plurality of bar elements in this connection form an arrangement of bar elements when all the bar elements of the arrangement are substantially disposed in the same plane, as shown in FIG. 3, or when all the bar elements are disposed in substantially parallel planes which are, however, slightly offset in the direction of the longitudinal axis, as shown in FIG. 4. An arrangement of bar elements consists in accordance with the embodiment in accordance with FIG. 3 of two or three bar elements. In this case, the first arrangement 21 of bar elements disposed in a plane 5 consists of the two bar elements 3, 13. The second arrangement 31 of bar elements disposed in a plane 6 consists of the bar elements 4, 14, 24. Two crossing planes 5, 6 are spanned by the first and second arrangements. The first and the second planes 5, 6 are arranged at an angle to one another so that the bar elements disposed in the first plane 5 intersect with the bar elements of the second plane 6 and form a line of intersection 7.

In accordance with FIG. 2, the following applies to the relative sum of the widths (H) of the bar elements in relation to the diameter of the hollow body:

$$z = \frac{\left(\sum_{i=1}^{N} Hi\right)}{D}$$

If the widths of the bar elements are all the same, it applies to z:

$$z=N*H/D,$$

where N is the sum of the bar elements of the first arrangement 21 and of the second arrangement 31. The outermost bar elements of an arrangement preferably contact the inner wall of the hollow body or have an at best only slight spacing from the inner wall.

The diameter of the hollow body is here in particular set forth for hollow bodies with a circular cross-section. The hollow body can also have an elliptical, polygonal, in particular rectangular or square cross-section. Instead of the diameter, a width measurement Db is then used for z to which the following relationship applies:

$$Db = \sum_{i=1}^{N} Hi + \sum_{i=1}^{N-1} ai$$

or, if the widths of the bar elements and the spacings are each the same, $$Db=N*H+(N-1)*a.$$

As above, the following then applies in the same way accordingly to z:

$$z=N*H/Db.$$

The width Db of the hollow body substantially corresponds to the width of the mixing element neglecting manufacturing and assembly tolerances. In accordance with the invention, in any case z<95%, preferably z<85%, in particular z<75%, particularly preferably z<65%. At the same time, in accordance with the invention, the sum of the surfaces of the bar elements of two crossing arrangements projected in perpendicular manner onto a plane also amounts in each case to less than 95% of the total cross-sectional area of the plane, preferably less than 85% of the total plane, in particular less than 75% of the total plan and particularly preferably less than 65% of the total plane. The number N of bar elements preferably amounts to a minimum of 4 and a maximum of 10. Usual production tolerances or installation tolerances are not considered in this formula. If the bar elements do not contact the inner wall of the hollow body, the installation and removal of a plurality of completely prefabricated mixing elements can be effected more simply. Any and all thermal expansions of the mixing element can take place largely unhindered during operation. Depending on the flowing medium and on the construction design of the mixing element, dead zones can form in marginal regions if the bar elements are directly connected to the inner wall of the hollow body. It can also be advantageous for this reason to provide a small spacing between the inner wall of the hollow body and at least some of the bar elements, as has already been presented in EP 0 856 353 A1.

A further embodiment is shown in FIG. 4. Differing from FIG. 3, all bar elements (3, 13, 23) of a first arrangement 21 are not disposed in one plane 5, but rather some of the bar elements are disposed in a plane 5' which is substantially parallel, but which is at least slightly displaced in the direction of the longitudinal axis.

In an extensive study, the geometrical parameters which describe the static mixing element were systematically varied and the resulting properties of the mixer were evaluated with respect to pressure loss and mixing efficiency.

So that static mixers of different lengths can be compared with one another with respect to pressure loss, the pressure loss was calculated per mixer length in the optimisation.

The mixing quality in a plane A is described by means of the coefficient of variation CoV. It is defined as the standard deviation of the concentration distribution in A standardised with the mean value of the concentration $\bar{c}$ in A.

$$CoV = \frac{\sqrt{\frac{1}{A}\int_A (c-\bar{c})^2\, dA}}{\bar{c}}$$

$$\bar{c} = \frac{1}{A}\int_A c\, dA$$

With a better mixing, the CoV becomes smaller. For the comparison of different mixers, the reduction in the coefficient of variation CoV was determined over a predetermined mixer length with the same distribution and thus also the same CoV before the mixers; the mixer which has a smaller CoV in accordance with the predetermined length therefore mixes more intensely or better.

The result of this study shows that mixing elements have significantly more favourable properties which have a spacing (a) between the crossing bar elements. The spacing (a) is preferably approximately of the same magnitude as the width (H) of the bar elements. The pressure loss with the same throughput and the same flow cross-section can hereby be substantially reduced with respect to the prior art with the same and/or an improved mixing quality after a predetermined length. A reduction by ⅔ of the pressure loss is possible with the same mixing quality or even better.

The result of this study is shown in FIG. 5 with respect to the pressure loss per mixer length and with respect to the mixer quality after a predetermined mixer length of the mixing element in accordance with the invention in different embodiment variants in comparison with the prior art in accordance with CH 642 564. In this connection, the pressure loss relative to the pressure loss of the prior art is entered on the abscissa and the mixing quality after a predetermined mixer length relative to the mixing quality of the prior art after the same mixer length is entered on the ordinate. The individual point 19 corresponds to the value pair for relative pressure loss and mixing quality in accordance with the prior art. This value pair was standardised to (1,1) in the representation; the relative pressure loss in accordance with the invention is accordingly between 20 and 80% of the pressure loss in accordance with the prior art. The CoV after a predetermined mixer length is between 75% and 125% of the value in accordance with the prior art. The shape of the graph 20 thus clearly shows that even a significant improvement of the mixing quality, in particular a CoV between 75 and 100% can be recorded despite the substantially lower pressure loss. It must again be noted here in this respect that a smaller CoV in accordance with the above definition stands for a better mixing quality. By a suitable design, the relative pressure loss can be reduced by more than ⅔ of the pressure loss of the prior art. In other variants, the mixing quality after a predetermined mixer length can be improved by up to 20% with respect to the prior art in accordance with CH 642 564, with simultaneously a reduction in the pressure loss to more than 50% being recordable with respect to the mixer in accordance with CH 642 564. The mixing element shown in FIG. 3 corresponds in the diagram to a point with around 60% less pressure loss than the prior art with simultaneously 20% better mixing quality after the same mixer length.

In accordance with the embodiments in accordance with FIGS. 3 and 4, spacer elements (15, 16) are arranged at least partly between adjacent bar elements. The installation of the bar elements can be made possible or simplified by means of the spacer elements. In addition, the spacer elements can serve for the increasing of the stability of the static mixing element. In this connection, spacer elements can be separate components which can be connected, by welding for example, to the bar elements or can also be made in the form of local thickened portions or widened portions. An example for such a widened section in the region of the bar element close to the wall is shown in FIG. 6.

FIG. 6 shows a detail of an intersection region of two bar elements 3, 4 having spacer elements 15, 16 in the form of local thickened portions and widened portions. These thickened portions serve for the connection of the two bar elements to one another. The thickened portions are substantially limited to the intersection region. Since the thickened portion 16 only represents a local connection of the bar elements, it has at best a small influence on the flow.

The invention claimed is:

1. A static mixing element having a predetermined width for installation into a hollow body having a width substantially equal to said predetermined width, said mixing element including a first arrangement including at least one first bar element arranged cross-ways to a second arrangement including at least one second bar element with the first arrangement and the second arrangement including an angle different from 0° to a longitudinal axis of said mixing element and the first arrangement including an angle greater than 0° with the second arrangement, said mixing element having intermediate spaces disposed at least partly between mutually adjacent bar elements on the projection of the first arrangement and of the second arrangement onto a projection plane which is disposed normal to said longitudinal axis characterised in that each of the bar elements is disposed with a width H and the relative sum z of the widths H of the bar elements measured in the direction of said predetermined width of said mixing element is less than 95% of said predetermined width of the mixing element and wherein a line of intersection, in whose proximity a spacer element is arranged, is formed by the first arrangement and the second arrangement.

2. A static mixing arrangement in accordance with claim 1 wherein the spacer element is made as one of a local thickened portion and widened portion of at least one bar element.

3. A static mixing arrangement in accordance with claim 1 wherein the number of bar elements in the projection plane amounts to 4 to 10.

4. A static mixing arrangement in accordance with claim 1 wherein at least two bar elements per arrangement are provided.

5. A static mixing arrangement in accordance with claim 4, wherein first and third bar elements are part of the first arrangement of bar elements disposed in a first plan and second and fourth bar elements are part of the second arrangement of bar e elements disposed in a second plane.

6. A static mixing arrangement in accordance with claim 5, wherein at least some of the bar elements of the first arrangement are arranged in a third plane which is arranged offset to the first plane and/or at least some of the bar elements of the second arrangement are arranged in a fourth plane, with the fourth plane being arranged offset to the second plane.

7. A static mixing arrangement in accordance with claim 1 wherein z is less than 65%.

8. A static mixing apparatus comprising a hollow body having a longitudinal axis and defining a flow path of predetermined width along said axis; and a static mixing element in said body and having a width substantially equal to said predetermined width, said mixing element including a first arrangement including at least one first bar element arranged cross-ways to a second arrangement including at least one second bar element with the first arrangement and the second arrangement including an angle different from 0° to said longitudinal axis and the first arrangement including an angle greater than 0° with the second arrangement, said mixing element having intermediate spaces disposed at least partly between mutually adjacent bar elements on the projection of the first arrangement and of the second arrangement onto a projection plane disposed normal to said longitudinal axis characterised in that each of the bar elements is disposed with a width H and the relative sum z of the widths H of the bar elements measured in the direction of said predetermined width is less than 95% of said predetermined width and wherein a line of intersection, in whose proximity a spacer element is arranged, is formed by the first arrangement and the second arrangement.

9. A static mixing apparatus in accordance with claim 8, wherein said static mixing element is fastened to said hollow body.

10. A static mixing apparatus in accordance with claim 8, wherein said static mixing element and said hollow body are attached to each other as a single integral device.

11. A static mixing apparatus in accordance with claim 8 wherein said static mixing element has first and third bar elements of said first arrangement of bar elements disposed in a first plane and second and fourth bar elements of said second arrangement of bar elements disposed in a second plane and wherein said static mixing element is fastened to the inner wall of said hollow body in a region of the point of intersection of said first plane with said second plane.

12. A static mixing element comprising a first arrangement of bar elements of predetermined width disposed in parallel;

a second arrangement of bar elements of predetermined width disposed in parallel and angular disposed with respect to said first arrangement, said bar elements of said second arrangement being disposed in alternating intersecting and spaced apart relation with said bar elements of said first arrangement; and a plurality of spacer elements, each said spacer element being disposed between a respective bar element of said first arrangement and a respective bar element of said second arrangement; and wherein said first and said second arrangements of bar elements define a total predetermined width and the sum of said predetermined widths of said bar elements is less than 95% of said total predetermined width of said first and said second arrangements of bar elements.

13. A static mixing element as set forth in claim 12 wherein said bar elements of said first arrangment are disposed in a first plane and said bar elements of said second arrangment are disposed in a second plane angularly disposed to said first plane.

14. A static mixing element as set forth in claim 12 wherein said bar elements of said first arrangement are disposed in axially offset relation to each other and said bar elements of said second arrangement are disposed in axially offset relation to each other.

15. A static mixing element as set forth in claim 12 wherein said bar elements of said first and said second arrangements are of equal width.

16. A static mixing element as set forth in claim 12 wherein said bar elements of said first and said second arrangements are equi-spaced.

17. A static mixing element as set forth in claim 12 wherein the sum of said predetermined width of said bar elements is less than 65% of said total predetermined width of said first and said second arrangements of bar elements.

18. A static mixing element as set forth in claim 12 wherein the sum of said predetermined widths of said bar elements is less than 85% of said total predetermined width of said first and said second arrangements of bar elements.

* * * * *